US009809946B2

(12) United States Patent
Van Gemert et al.

(10) Patent No.: US 9,809,946 B2
(45) Date of Patent: Nov. 7, 2017

(54) DEMOLITION APPARATUS

(71) Applicant: Caterpillar Work Tools B.V., 'S Hertogenbosch (NL)

(72) Inventors: John Van Gemert, Mill (NL); Willem Hooijmans, Maasdriel (NL); Henry Dings, Maasdriel (NL); Patrick Grant, Tilburg (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 791 days.

(21) Appl. No.: 14/346,834

(22) PCT Filed: Oct. 4, 2012

(86) PCT No.: PCT/EP2012/069637

§ 371 (c)(1),
(2) Date: Mar. 24, 2014

(87) PCT Pub. No.: WO2013/050482

PCT Pub. Date: Apr. 11, 2013

(65) Prior Publication Data

US 2014/0231564 A1 Aug. 21, 2014

(30) Foreign Application Priority Data

Oct. 5, 2011 (EP) ..... 11184008

(51) Int. Cl.

| | |
|---|---|
| ***B02C 1/02*** | (2006.01) |
| ***E02F 3/36*** | (2006.01) |
| ***B02C 21/02*** | (2006.01) |
| ***E02F 3/96*** | (2006.01) |

(52) U.S. Cl.

CPC ..... *E02F 3/3686* (2013.01); *B02C 1/02* (2013.01); *B02C 21/026* (2013.01); *E02F 3/3618* (2013.01); *E02F 3/3622* (2013.01); *E02F 3/965* (2013.01); *Y10T 29/49826* (2015.01)

(58) Field of Classification Search

CPC ..... B02C 1/02; B02C 21/02; B02C 21/026; E02F 3/3686; E02F 3/3618; E02F 3/34; E02F 3/404

USPC ..... 241/264, 266

See application file for complete search history.

(56) References Cited

U.S. PATENT DOCUMENTS

| | | | | |
|---|---|---|---|---|
| 4,295,287 A | | 10/1981 | Natzke et al. | |
| 5,382,110 A | | 1/1995 | Perotto et al. | |
| 5,549,440 A | | 8/1996 | Cholakon et al. | |
| 6,119,970 A | * | 9/2000 | LaBounty | B23D 17/00 241/101.73 |

(Continued)

FOREIGN PATENT DOCUMENTS

| | | |
|---|---|---|
| CN | 101014424 | 8/2007 |
| EP | 0641618 | 8/1995 |

(Continued)

*Primary Examiner* — Faye Francis

(57) ABSTRACT

A demolition apparatus and an adapter frame of the demolition apparatus are disclosed. The adapter frame may be formed with coupling seats which engage pins on a jaw set to assemble the demolition apparatus. The openings of the coupling seats face different directions for quick and simple assembly of the demolition apparatus. A rotatable locking element may be provided on the adapter frame to lock a pin on the jaw set.

3 Claims, 13 Drawing Sheets

(56) References Cited

U.S. PATENT DOCUMENTS

| | | | | |
|---|---|---|---|---|
| 7,284,718 | B2 * | 10/2007 | Christenson | E02F 3/965<br>241/101.73 |
| 7,473,067 | B2 * | 1/2009 | Nishioka | E02F 3/3618<br>37/468 |
| 7,797,862 | B2 * | 9/2010 | Daraie | E02F 3/3618<br>37/468 |
| 7,984,575 | B2 * | 7/2011 | Robl | E02F 3/3622<br>172/273 |
| 8,469,623 | B2 * | 6/2013 | Luyendijk | E02F 3/364<br>37/468 |
| 8,662,817 | B2 * | 3/2014 | Daraie | E02F 3/3618<br>172/272 |
| 2005/0199758 | A1 * | 9/2005 | Ramun | A62B 3/005<br>241/266 |
| 2006/0157605 | A1 * | 7/2006 | Ramun | E02F 3/302<br>241/266 |
| 2007/0001041 | A1 | 1/2007 | Christenson | |
| 2011/0297773 | A1 * | 12/2011 | Nye | E04G 23/08<br>241/101.73 |

FOREIGN PATENT DOCUMENTS

| | | | |
|---|---|---|---|
| EP | 1571265 | | 7/2005 |
| EP | 2264248 | | 12/2010 |
| EP | 2354328 | | 7/2011 |
| GB | 2446485 | A | 8/2008 |
| JP | 2000-192495 | A | 7/2000 |

* cited by examiner

DEMOLITION APPARATUS

TECHNICAL FIELD

This disclosure relates to the field of demolition apparatuses for crushing and/or cutting material and more particularly to the field of demolition apparatuses having interchangeable jaw sets and frames adapted to receive the jaw sets.

BACKGROUND

A device for crushing and/or cutting material is generally known. The device may have a jaw set for example suitable for crushing concrete. A different jaw set may be used for crushing or cutting other materials, for example for cutting scrap iron and/or iron sections. Thus, different devices may be used for crushing or cutting different materials. The jaw sets may be interchangeable in order to be used for varying work requirements.

European patent No. 0641618 may disclose a device having an interchangeable jaw set including a first jaw and a second jaw. The device may comprise a frame for connection to an arm of a machine.

The first jaw may be fixedly connected to the frame by means of fixing pins. Two pin bores in the first jaw may be aligned with corresponding openings in the frame for receiving the fixing pins. The fixing pins may be inserted and removed through the aligned openings and pin bores by means of a hand tool.

The second jaw may be pivotably connected to the frame to be movable relative to the first jaw and the frame. The second jaw may be pivoted about one of the fixing pins which connects the first jaw to the frame by a setting cylinder. The setting cylinder may be connected to an end of the second jaw spaced from the pivot point.

The connecting and disconnecting method of European patent No. 0614618 may be laborious and time-consuming.

European patent No. 1571265 may disclose a device having an interchangeable jaw set including a first jaw and a second jaw. The device may comprise a frame for connection to an arm of a machine.

The first jaw may be connected to the frame and may be fixed relative to the frame. The second jaw may mate with the first jaw and may be pivotable about a pivot pin with respect to the frame through a setting cylinder.

The first jaw may be provided with projecting pins that interlock with coupling means that form part of the frame for hooking the first jaw to the frame. The coupling means may be configured as hook-shaped parts which engage the projecting pins on the first jaw. The first jaw and the second jaw may be connected to the frame by skillfully pivoting the frame part by means of the jib of an excavator.

The device may include fixing means for keeping the projecting pins and the coupling means interlocked. The fixing means may be provided with an extension element that may be extended after the projecting pin and the coupling means have been hooked together to retain projecting pins in the coupling means.

The present disclosure is directed, at least in part, to improving or overcoming one or more aspects of the prior art system.

BRIEF SUMMARY OF THE INVENTION

In a first aspect, the present disclosure describes an adapter frame of a demolition apparatus, the adapter frame comprising a housing provided with spaced-apart first and second coupling seats to engage with a jaw set and a mounting member for connection to an arm of a machine and at least one locking element rotatably supported at one of the second coupling seats.

In a second aspect, the present disclosure describes a demolition apparatus comprising a jaw set having a first jaw pivotally connected to a second jaw, the jaw set further comprising a pivot pin and a coupling pin provided on the first jaw; a frame connectable to an arm of a machine, the frame provided with spaced-apart first and second coupling seats to engage with the pivot pin and the coupling pin and a cylinder to pivot the first jaw relative to the second jaw; and at least one locking element rotatable supported at one of the second coupling seats for retaining the coupling pin.

In a third aspect, the present disclosure describes an adapter frame of a demolition apparatus, the adapter frame comprising a housing provided with spaced-apart first and second coupling seats to engage with a jaw set and a mounting member for connection to an arm of a machine, wherein the openings of the first coupling seat and the second coupling seat face different directions.

In a fourth aspect, the present disclosure describes a demolition apparatus comprising a jaw set having a first jaw pivotally connected to a second jaw, the jaw set further comprising a pivot pin and a coupling pin provided on the first jaw; a frame connectable to an arm of a machine, the frame provided with spaced-apart first and second coupling seats to engage with the pivot pin and the coupling pin and a cylinder to pivot the first jaw relative to the second jaw, wherein the openings of the first coupling seat and the second coupling seat face different directions.

In a fifth aspect, the present disclosure describes a method, the method comprising the steps of providing a jaw set having a first jaw pivotally connected to a second jaw, the jaw set further comprising and a coupling pin provided on the first jaw; connecting a frame to an arm of a machine, the frame having spaced-apart first and second coupling seats to engage with the pivot pin and the coupling pin and a cylinder to pivot the first jaw relative to the second jaw, wherein the openings of the first coupling seat and the second coupling seat face different directions; moving the frame to engage the pivot pin into the first coupling seats; and engaging the coupling pin into the second coupling seats through rotation of the jaw set relative to the adapter frame.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a demolition apparatus 10 for crushing and/or cutting material.

Figure 1:
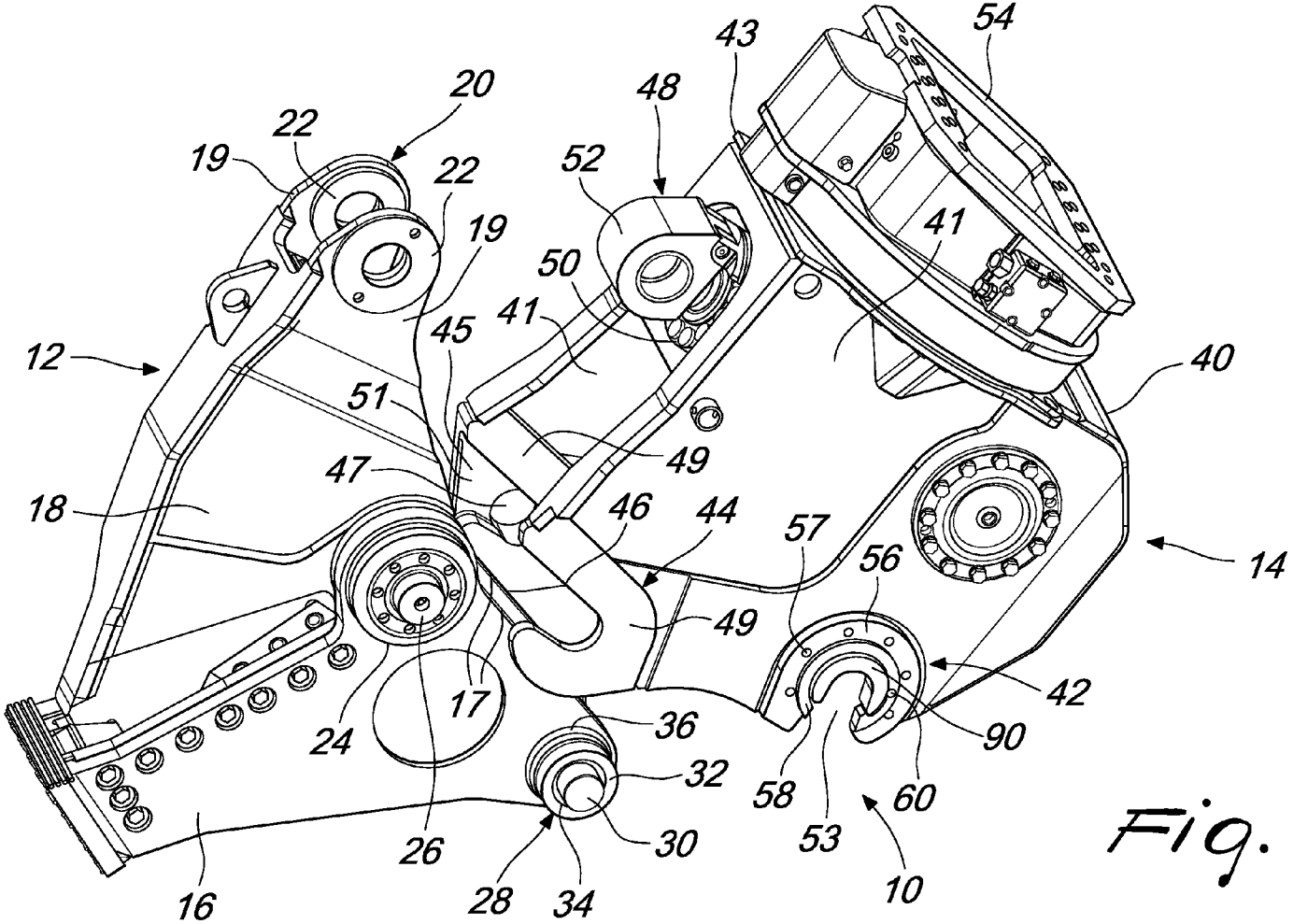
FIG. 1 is an isometric view of a demolition apparatus according to the present disclosure.

FIG. 1 illustrates a demolition apparatus 10. The demolition apparatus 10 may comprise a jaw set 12 and an adapter frame 14. The jaw set 12 and the adapter frame 14 may be mutually connectable. The jaw set 12 and the adapter frame 14 may be configured for mutual connection.

The jaw set 12 may comprise a first jaw 16 and a second jaw 18. The first jaw 16 and the second jaw 18 may be suitably provided for crushing concrete and/or cutting iron sections.

In an embodiment, the first jaw 16 may comprise two spaced-apart and parallel plates 17. The plates 17 may be provided at an end of the first jaw 16. The first jaw 16 may be provided with crushing or cutting tools for crushing or cutting activity. The crushing or cutting tools may be connected to plates 17 of the first jaw 16. The crushing or cutting tools may be suitably configured for engaging with the second jaw 18 for crushing or cutting activity. In an embodiment, the crushing or cutting tools may be blades, teeth or any other form of material engaging component.

In an embodiment, the second jaw 18 may comprise two spaced-apart and parallel plates 19 at one end. The plates 19 may be provided at an end of the second jaw 18. The second jaw 18 may be provided with crushing or cutting tools for crushing or cutting activity. The crushing or cutting tools may be connected to plates 19 of the second jaw 18. The crushing or cutting tools may be suitably configured for engaging with the first jaw 16 for crushing or cutting activity. In an embodiment, the crushing or cutting tools may be blades, teeth or any other form of material engaging component.

The first jaw 16 and the second jaw 18 may be pivotally connected.

In an embodiment, the first jaw 16 and the second jaw 18 may be pivotally connected by a pivot pin 26. The pivot pin 26 may extend through the first jaw 16 and the second jaw 18 at the position of the pivotal connection.

In an embodiment, the ends of the pivot pin 26 may protrude from both sides of the jaw set 12. The ends of the pivot pin 26 may protrude perpendicularly with respect to the first jaw 16 and the second jaw 18.

In an embodiment, the pivot pin 26 may be a collared pin having an end protruding from the jaw set 12. The end of the pivot pin 26 may protrude perpendicularly with respect to the first jaw 16 and the second jaw 18. A collar opposite the protruding end may abut the jaw set 12. A rod may extend from the collar in a direction opposite the protruding end and coaxially with the longitudinal axis of the pivot pin 26. The rod may have the same diameter as the body of the pivot pin 26.

In an embodiment, the first jaw 16 and the second jaw 18 may be retained on the pivot pin 26 without play along the length of the pivot pin 26. The first jaw 16 and the second jaw 18 may be retained on the pivot pin 26 so that lateral movement may be restricted and rotational movement may not be restricted.

A lock ring 24 may be positioned at the end of the pivot pin 26 protruding from the jaw set 12 to engage and lock the pivot pin 26 with respect to the jaw set 12. In an embodiment, the lock rings 24 may be positioned at both ends of the pivot pin 26 protruding at both ends of the jaw set 12.

The first jaw 16 and the second jaw 18 may each be provided with a passage to accommodate the pivot pin 26. In an embodiment, the plates 17, 19 may be provided with passages to accommodate the pivot pin 26. In an embodiment, the lock ring 24 may be positioned between the end of the pivot pin 26 and the plates 17 or plates 19.

In an embodiment, the first jaw 16 and the second jaw 18 may be pivotally connected by a bushing. A pivot pin 26 may extend through the bushing, the first jaw 16 and the second jaw 18 at the position of the pivotal connection.

In an embodiment, an end of the pivot pin 26 may extend from a side of the jaw set 12. In this embodiment, the pivot pin 26 may be a collared pin. A collar opposite the protruding end may abut the jaw set 12. The end of the pivot pin 26 may protrude perpendicularly with respect to the first jaw 16 and the second jaw 18.

In an embodiment, the ends of the pivot pin 26 may protrude from both sides of the jaw set 12. The ends of the pivot pin 26 may protrude perpendicularly with respect to the first jaw 16 and the second jaw 18.

In an embodiment, the first jaw 16 and the second jaw 18 may be retained on the bushing without play along the length of the bushing. The first jaw 16 and the second jaw 18 may be retained on the bushing so that lateral movement may be restricted and rotational movement may not be restricted. The bushing may include collared ends to retain the first jaw 16 and the second jaw 18.

In an embodiment, the first jaw 16 and the second jaw 18 may be retained on the bushing without play along the length of the bushing by the lock rings 24 engaging the ends of the pivot pin 26.

The first jaw 16 and the second jaw 18 may each be provided with a passage to accommodate the bushing. In an embodiment, the plates 17, 19 may be provided with passages to accommodate the bushing.

The jaw set 12 may comprise a coupling pin 28. The coupling pin 28 may be spaced from the pivotal connection of the first jaw 16 and the second jaw 18. The coupling pin 28 may be spaced from the pivot pin 26. The pivot pin 26 may be positioned along an end of the jaw set 12.

The coupling pin 28 may be located on the first jaw 16. The coupling pin 28 may comprise a rod member 30 and a ring member 32.

In an embodiment, the rod member 30 may protrude from both sides of the first jaw 16. The rod member 30 may protrude in opposite directions from both plates 17 of the first jaw 16. The ends of the rod member 30 may protrude perpendicularly with respect to the first jaw 16. The longitudinal axis of the rod member 30 may extend parallel to the longitudinal axis of the pivot pin 26.

In an embodiment, the rod member 30 may be a collared pin having an end protruding from the first jaw 16. The end of the rod member 30 may protrude perpendicularly with respect to the first jaw 16. A collar opposite the protruding end may abut the first jaw 16. A rod portion may extend from the collar in a direction opposite the protruding end and coaxially with the longitudinal axis of the rod member 30. The rod portion may have the same diameter as the body of the rod member 30.

The rod member 30 may extend through the first jaw 16. The first jaw 16 may be provided with a passage to accommodate the rod member 30. In an embodiment, the rod member 30 may extend through the plates 17 of the first jaw 16. The plates 17 may be provided with passages to accommodate the rod member 30.

In an embodiment, the first jaw 16 may be retained on the rod member 30 without play along the length of the rod member 30. The first jaw 16 may be retained on the rod member 30 so that lateral movement may be restricted. In an embodiment, a retaining clip may retain the first jaw 16 and the rod member 30 from relative movement.

A ring member 32 may encircle the protruding end of the rod member 30. In an embodiment, a ring member 32 may be positioned about both the protruding ends of the rod member 30. The ring member 32 may be provided on the side of the first jaw 16. The ring member 32 may be welded on the side of the first jaw 16. The ring member 32 may be welded on the plate 17. A welding joint 36 may join the base of the ring member 32 to the plate 17.

The rod member 30 may have a smaller diameter than the internal diameter of the ring member 32. The rod member 30 may be longer than the ring member 32 such that the rod member 30 may protrude further from the first jaw 16 than the ring member 32.

The ring member 32 and the rod member 30 may be formed as separate bodies. The ring member 32 and the rod member 30 may be fitted with a tight tolerance so that a load applied on the rod member 30 may be distributed through the ring member 32 to the adapter frame 14.

In an embodiment, the ring member 32 may be configured so that the inner surface of the ring member 32 may be stepped such as to provide a groove 34 with respect to rod member 30. The groove 34 may be limited by the stepped inner surface of the ring member contacting the rod member 30.

In an embodiment, the ring member 32 and the rod member 30 may be formed as a single welded body.

The jaw set 12 may further comprise an actuation portion 20. The actuation portion 20 may be formed on the second jaw 18. The actuation portion 20 may be an extension of an end of the second jaw 18. The actuation portion 20 may be an extension of the ends of plates 19. The actuation portion may be provided with stiffened passages 22. The stiffened passages 22 may be suitable to receive and accommodate an actuation pin for coupling to a cylinder 48.

The actuation portion 20 and the coupling pin 28 may be positioned at opposed ends of the jaw set 12. The pivot pin 26 may be positioned between the actuation portion 20 and the coupling pin 28.

Figure 2:
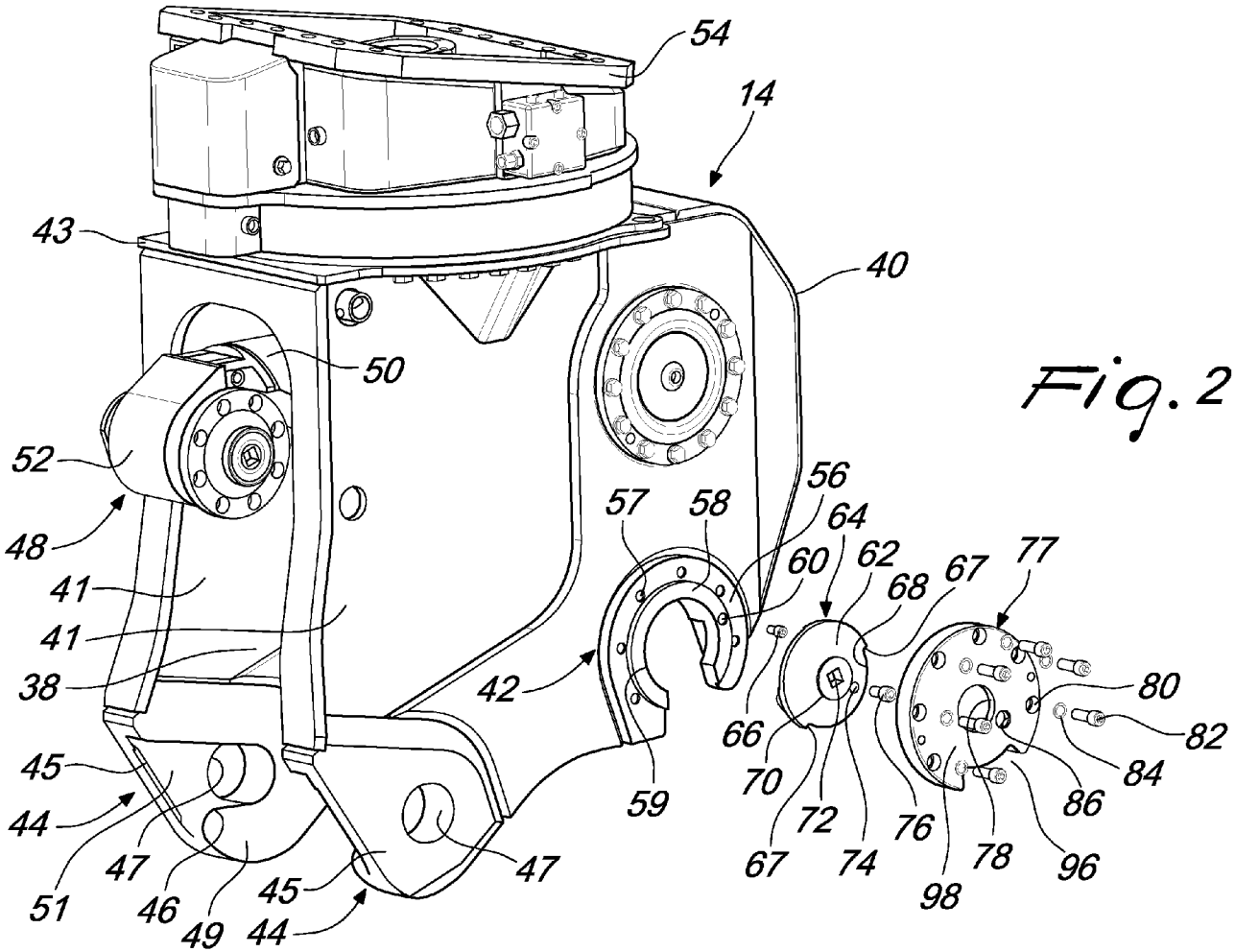
FIG. 2 is an isometric view of an adapter frame of the demolition apparatus of FIG. 1 having a locking element and a lock cover in an exploded view.
Figure 3:
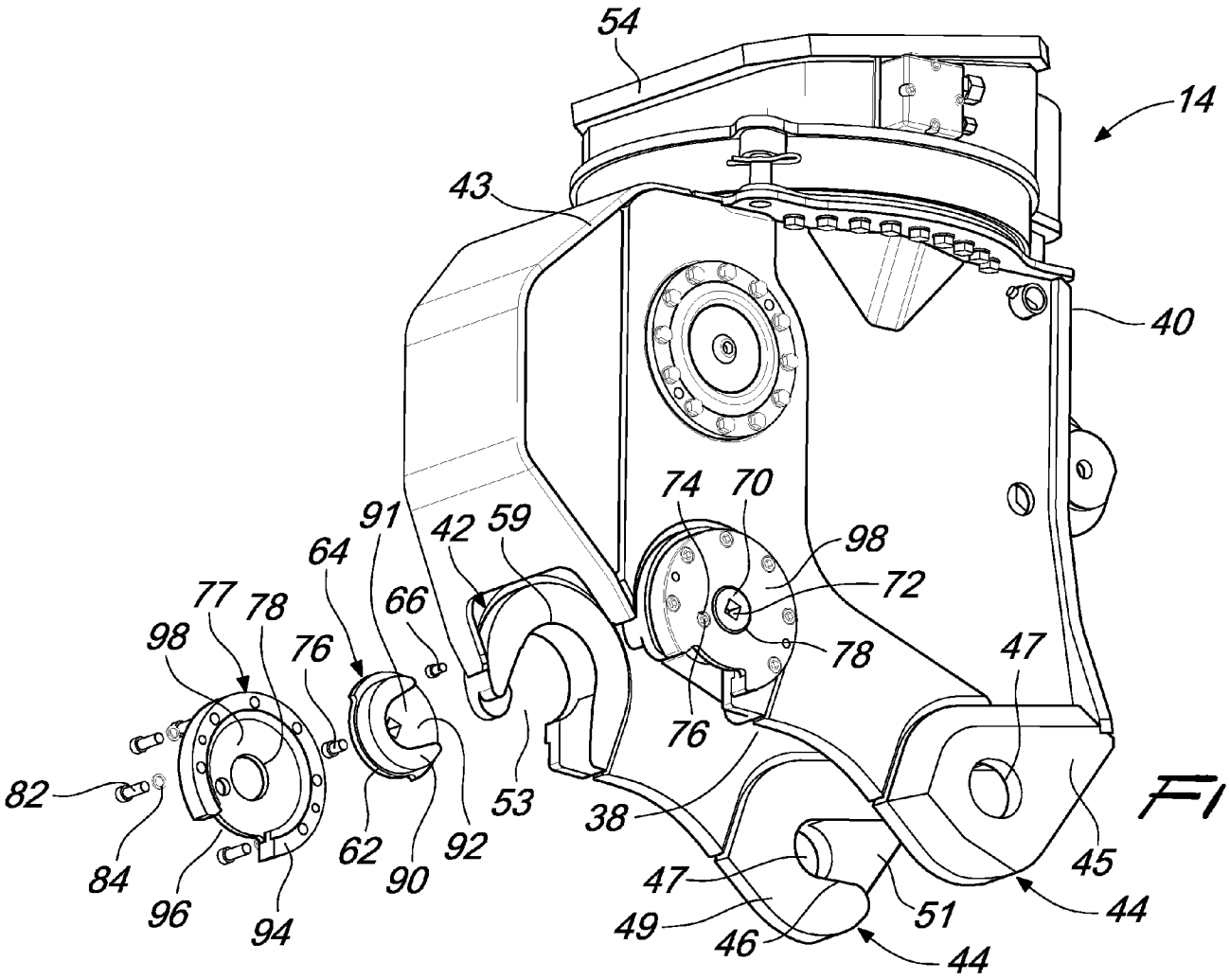
FIG. 3 is a reverse isometric view of the adapter frame of FIG. 2.
Figure 4:
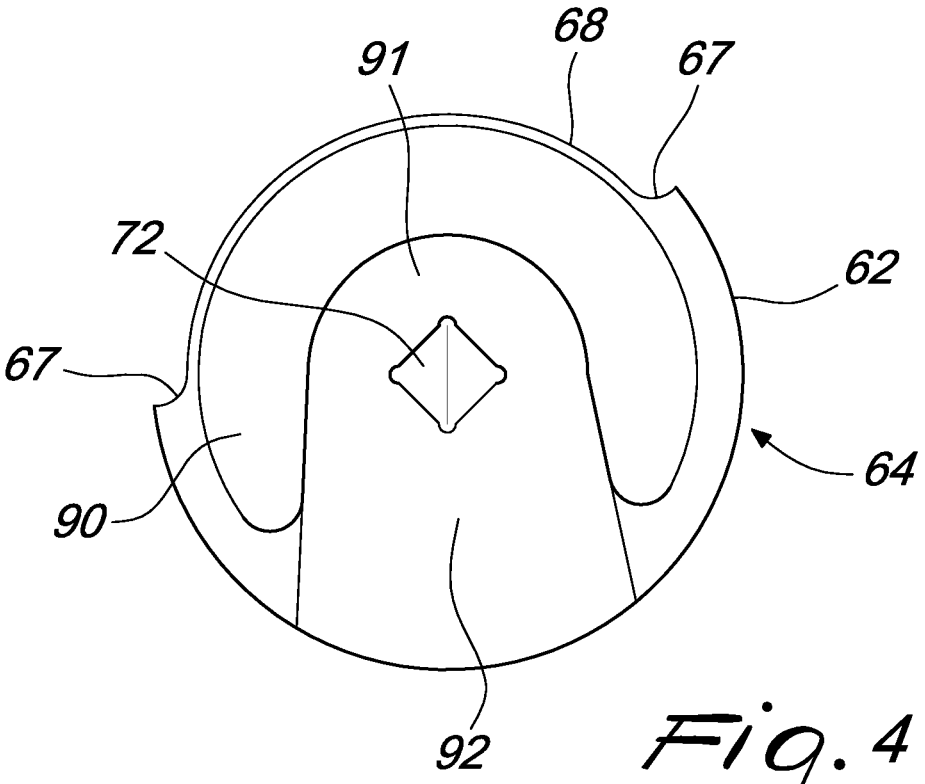
FIG. 4 is a plan view of the locking element of FIG. 2.
Figure 5:
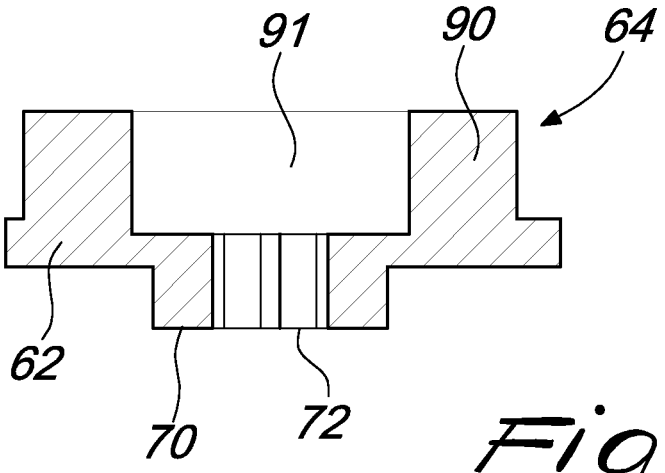
FIG. 5 is a cross section view of the locking element of FIG. 2.

With reference to FIGS. 1 to 3, the adapter frame 14 may comprise a housing 40. The housing 40 may comprise spaced-apart frame plates 41 and may bound a void 38. The frame plates 41 may be mutually parallel. The void 38 may extend between and along the length of the frame plates 41.

The frame plates 41 may be connected to an end plate 43. The end plate 43 may be connected to ends of the frame plates 41 at an end of the housing 40 to form a limit for the void 38. The frame plates 41 may extend perpendicularly from the end plate 43. The end plate 43 may bound at least two sides of the frame plates 41. In an embodiment, the end plate 43 may be substantially L-shaped in cross section. The sides of the frame plates 41 not bound by the end plate 43 may expose the void 38 to the exterior of the housing 40.

A cylinder 48 may be positioned in the housing 40. The cylinder 48 may be positioned in the void 38 between the frame plates 41 and adjacent to the end plate 43. The cylinder body 50 may extend into the void 38 between frame plates 41. The piston rod head 52 may be positioned beyond the sides of frame plates 41 not bound by the end plate 43. The piston rod head 52 may extend in a direction away from the frame plates 41 and the housing 40. The direction of extension of piston rod head 52 may be parallel to the frame plates 41.

A mounting member 54 may be provided on the housing 40. The mounting member 54 may enable the adapter frame 14 to connect to an arm of a machine, for example a jib of an excavator. The mounting member 54 may be suitably configured for the connection of the adapter frame 14 to the machine arm. The mounting member 54 may be provided on the end plate 43. The mounting member 54 may be positioned adjacent the cylinder 48.

The housing 40 may be provided with first and second coupling seats 44, 42.

The first coupling seats 44 may form the first points of engagement of the jaw set 12 and the adapter frame 14. The first coupling seats 44 may engage the pivot pin 26 on the jaw set 12. The first coupling seats 44 may have openings 51 to receive the pivot pin 26. The first coupling seats 44 may have openings 51 to receive the ends of the pivot pin 26.

The second coupling seats 42 may form the second points of engagement of the jaw set 12 and the adapter frame 14. The second coupling seats 42 may engage the coupling pin 28 on the jaw set 12. The second coupling seats 42 may have openings 53 to receive the coupling pin 28. The second coupling seats 42 may have openings 53 to receive the ring member 32.

In an embodiment, the adapter frame 14 of the demolition apparatus 10 may comprise the housing 40 having the spaced-apart first and second coupling seats 44, 42 to engage with the jaw set 12. The housing 40 may further have the mounting member 54 for connection to the arm of the machine. The openings 51, 53 of the first and second coupling seats 44, 42 may face different directions.

The demolition apparatus 10 may comprise a jaw set 12 having a first jaw 16 pivotally connected to a second jaw 18. The jaw set 12 may further comprise a pivot pin 26 extending through the pivotal connection of the first and second jaw 16, 18 and a coupling pin 28 provided on the first jaw 16. The adapter frame 14 that is connectable to the arm of the machine may have a housing 40 provided with spaced-apart first and second coupling seats 44, 42 to engage with the pivot pin 26 and the coupling pin 28. The housing 40 may have a cylinder 48 to pivot the second jaw 18 relative to the first jaw 16 wherein the openings 51, 53 of the first coupling seat 44 and the second coupling seat 42 face different directions.

The openings 51 of the first coupling seats 44 may face a different direction relative to the openings 53 of the second coupling seats 42. In an embodiment, the openings 51 of the first coupling seats 44 may face the direction of extension of the cylinder 48. In an embodiment, the openings 53 of the second coupling seats 42 substantially may face away from the cylinder 48.

In an embodiment, the first coupling seats 44 may engage the pivot pin 26 at a position facing the second coupling seats 42. In an embodiment, the first coupling seats 44 may engage the pivot pin 26 in a direction away from the second coupling seats 42.

In an embodiment, the first coupling seats 44 may engage the pivot pin 26 at a position facing the coupling pin 28. In an embodiment, the first coupling seats 44 may engage the pivot pin 26 in a direction away from the coupling pin 28.

In an embodiment, the pivot pin 26 may enter the openings 51 of the first coupling seats 44 at a position of the pivot pin 26 which faces the coupling pin 28. In an embodiment, the pivot pin 26 may enter the openings 51 of the first coupling seats 44 in a direction towards the coupling pin 28.

The first coupling seats 44 each may have an engagement path which is defined by the path of the pivot pin 26 for engaging the first coupling seats 44. The path of the pivot pin 26 into the first coupling seats 44 may be substantially straight. The second coupling seats 42 each may have an engagement trajectory which is defined by the path of the coupling pin 28 for engaging the second coupling seats 42. The path of the coupling pin 28 into the second coupling seats 42 may be substantially curved. The engagement path of the first coupling seats 44 intersects the engagement trajectory of the second coupling seats 42.

The first and second coupling seats 44, 42 may be formed on the frame plates 41. In an embodiment, the first and second coupling seats 44, 42 may be formed on the portion of the frame plates 41 not bound by the end plate 43 and opposite the mounting member 54.

The first and second coupling seats 44, 42 may be spaced-apart on the housing 40. The second coupling seats 42 and the first coupling seats 44 may be spaced-apart on each frame plate 41. The first coupling seats 44 may be mutually aligned on the housing 40. The first coupling seats 44 may be positioned on each frame plate 41 to mirror each other. The second coupling seats 42 may be mutually aligned on the housing 40. The second coupling seats 42 may be positioned on each frame plate 41 to mirror each other.

The first coupling seats 44 may comprise first abutment portions 49. The first abutment portions 49 may receive the pivot pin 26. In an embodiment, the first abutment portions 49 may have curved middles sections that are connected between free projecting stub ends and fixed sections. The fixed sections may be joined to the frame plates 41.

In an embodiment, the first abutment portions 49 may have a shape that is substantially hook-shaped. In an embodiment, the first abutment portions 49 may be hook-shaped. The fixed sections and the free projecting ends may have substantially non equal lengths. The free projecting stub ends may be shorter than the straight sections.

In an embodiment, the abutment portions 49 may be substantially u-shaped wherein the fixed sections and the free projecting stub ends may have a substantially equal lengths.

The fixed sections and the free projecting stub ends of the abutment portions 49 may be formed as linear or curved forms.

In an embodiment, the straight sections and the free projecting stub ends may be substantially linear and parallel. In an embodiment, the straight sections and the free projecting stub ends may be linear and inclined relative to each other.

FIG. 1 illustrates a section of a first coupling seat 44. The first abutment portions 49 may define slots 46. In an embodiment, the width of the slots 46 may be provided to receive the ends of the pivot pin 26. The pivot pin 26 may engage into the slots 46 and travel along the slot 46 to the end of the slot 46. In an embodiment, the openings 51 may be located at the slots 46. In an embodiment, the openings 51 may be defined by the free projecting stub ends and straight sections. The openings 51 may provide access into the slots 46.

In an embodiment, the entry path of the slots 46 may be configured such that the ends of the pivot pin 26 may travel through the slots with play. The ends of the slots 46 may determine the final resting position of the jaw set 12 relative to the housing 40. In an embodiment, the ends of the slots 46 facing the openings 51 may determine final resting position of the jaw set 12 relative to the housing 40. The ends of the slots 46 may have a shape corresponding to the shape of the pivot pin 26. The ends of the slots 46 may have a curved segment which connect to the straight sections of the slots 46.

The ends of the pivot pin 26 may have a tight fit with the ends of the slots 46 facing the openings 51. In an embodiment, the ends of the pivot pin 26 may have the same diameter as the ends of the slots 46 facing the openings 51.

With reference to FIGS. 1 to 3, the first coupling seats 44 may further comprise brackets 45 to guide the ends of the pivot pin 26 into the first coupling seats 44. The brackets 45 may be positioned on the first abutment portions 49. The brackets 45 may be positioned on the side of the first abutment portions 49 opposite the sides the first abutment portions 49 facing the void 38. In an embodiment, the openings 51 may be further defined by the brackets 45 with the first abutment portions 49.

Holes 47 may be formed in the brackets 45 in correspondent with the end of the slots 46. The holes 47 may be through-holes formed in the brackets 45. The holes 47 may enable fine machining of the ends of the slots 46 which receive the ends of the pivot pin 26.

In an embodiment brackets 45 may be flame cut part and the slots 46 may be roughly machined when the part is still a body disjoint from the housing 40. After the brackets 45 are welded onto the housing 40, the final geometry of shape of slots 46 may be made. The holes 47 are machined through the brackets 45 to reach the ends of the slots 46. The holes 47 may be machined as a final step to ensure the correct shape of the ends of the slots 46.

The second coupling seats 42 may comprise second abutment portions 56. The second abutment portions 56 may receive the coupling pin 28. In an embodiment, the second abutment portions 56 may be circular. In an embodiment, the second abutment portions 56 may be substantially C-shaped. Each second abutment portion 56 may have a curved body section and two free ends.

The second abutment portions 56 may define cavities 59. The ring member 32 may engage into the cavities 59 and slidingly engage second abutment portions 56. In an embodiment, the diameter of the cavities 59 may be provided to accommodate the ring member 32.

In an embodiment, the cavities 59 may have a central axis which is substantially perpendicular to the frame plates 41. The central axis may extend from the enclosure internally to the void 38 and in an opposite direction to the exterior of the housing 40.

In an embodiment, the openings 53 may be located at the cavities 59. The openings 53 may be defined by the free ends of the second abutment portions 56. The openings 53 may provide access into the cavities 59.

The second coupling seats 42 may further comprise rib portions 58. The rib portions 58 may extend from the second abutment portions 56 in a direction away from the void 38. The rib portions 58 may border the cavities 59. The rib portions 58 may have rib apertures 60. The rib apertures 60 may be threaded. A limit element 66 may fit into the rib apertures 60. In an embodiment, the limit element 66 may be a dowel.

The second abutment portions 56 may have bolt holes 57. The bolt holes 57 may be positioned around the rib portions 58. The bolt holes 57 may be positioned on the curved body sections of the second abutment portions 56.

In an embodiment, the adapter frame 14 of the demolition apparatus 10 may comprise the housing 40 having the spaced-apart first and second coupling seats 44, 42 to engage with the jaw set 12. The housing 40 may further have the mounting member 54 for connection to the arm of the machine. The adapter frame 14 may further have at least one locking element 64 rotatably supported at one of the second coupling seats 42.

In an embodiment, the adapter frame 14 may have a pair of locking elements 64 rotatably supported at the second coupling seats 42.

In an embodiment, the demolition apparatus 10 may comprise the jaw set 12 having the first jaw 16 pivotally connected to the second jaw 18. The jaw set 12 may further comprise a pivot pin 26 extending through the pivotal connection of the first and second jaws 16, 18 and a coupling pin 28 provided the first jaw 16. The adapter frame 14 that is connectable to the arm of the machine may have a housing 40 provided with spaced-apart first and second coupling seats 44, 42 to engage with the pivot pin 26 and the coupling pin 28. The housing may have a cylinder 48 to pivot the second jaw 18 relative to the first jaw 16. The demolition apparatus 10 may further have at least one locking element 64 rotatably supported at one of the second coupling seats 42 for retaining the coupling pin 28.

In an embodiment, the demolition apparatus 10 may have a pair of locking elements 64 rotatably supported at the second coupling seats 42.

With reference to FIGS. 2 to 5, the locking element 64 may engage and lock the coupling pin 28. The locking element 64 may engage and lock the rod member 30 of the coupling pin 28.

The locking element 64 may comprise a body 62. The body 62 may have a central axis. Each locking element 64 may comprise a retaining member 90 to receive and engage the coupling pin 28. The retaining member 90 may engage the rod member 30. The retaining member 90 may engage the ends of the rod member 30. The retaining member 90 may extend from a side of the body 62. The retaining member 90 may extend perpendicularly from the side of the body 62. The retaining member 90 may extend in parallel with the central axis.

In an embodiment, the retaining member 90 may have a curved body with two free ends. The free ends of each retaining member 90 may have rounded apexes which are formed opposite to the curved body.

In an embodiment, the retaining member 90 may be substantially C-shaped. The retaining member 90 may have a curvature and/or shape which corresponds to a curvature and/or shape of the abutment portion 56 of each second coupling seat 42.

The retaining member 90 may limit an enclosure 91 to receive and engage the rod member 30. The free ends of each retaining member 90 may define an enclosure aperture 92. The enclosure aperture 92 may provide access into the enclosure 91. With the C-shaped embodiment of the retaining member 90 the rod member 30 may be retained with some play.

In an embodiment, the inner surface of the retaining member 90 that faces the enclosure 91 may have a different curvature to the curvature of the rod member 30. The inner surface of the retaining member 90 may be formed as an arcuate wedge surface. The retaining member 90 may be configured to, upon progressive rotation of the locking element 64, apply a progressively increasing tightening pressure to the rod member 30. The rod member 30 may be held without play within the enclosure 91.

In an example, the arcuate wedge surface may be positioned about the central axis in a generally spiraling relationship such that the arcuate wedge surface at least partially surrounds the axis 140 at radial positions progressively further from the axis.

In an embodiment, the locking element 64 may be a disk. The retaining member 90 may have a curvature and/or shape which corresponds to a portion of the circumference of body 62.

The locking element 64 may have a cut-out arc 68 extending along a portion of the circumference of the locking element 64. The cut-out arc 68 may be formed by the removal of a portion of the locking element 64. The locking element 64 may have reduced radii at any point along the cut-out arc 68 with respect to any radii at any point along the circumference beyond the cut-out arc 68.

The ends of the locking element 64 may be bound by stop limits 67. The stop limits 67 may form part of the locking element 64. The stop limits 67 may be formed by the removal of a portion of the locking element 64 to form the cut-out arc 68. The stop limits 67 may operate with the limit element 66 to restrict the rotation of the locking element 64.

The cut-out arc 68 may be aligned on the locking element 64 relative to the position of retaining member 90. The cut-out arc 68 may be aligned to the side of the retaining member 90 which is opposite the enclosure aperture 92. The cut-out arc 68 may have a curvature which corresponds to the retaining member 90. In an embodiment, the cut-out arc 68 may extend along the side of the retaining member 90. In an embodiment, the cut-out arc 68 may extend along a portion of the side of the retaining member 90. The cut-out arc 68 may be spaced from the retaining member 90

Each locking element 64 may further comprise a collar 70. The collar 70 may extend from a side of the body 62 opposite the side having the retaining member 90. The collar 70 may extend perpendicularly from the side of the body 62. The collar 70 may be positioned in the centre of the body 62.

An actuation hole 72 may be provided in the collar 70. The actuation hole 72 may extend through the collar 70. In an embodiment, the actuation hole 72 may be a blind hole extending to the body 62. In an embodiment, the actuation hole 72 may be a through hole extending up to and through the body 62. The actuation hole 72 may extend into the enclosure 91. The actuation hole 72 may be configured to receive a tool to effect the rotation of the locking element 64.

In an embodiment, the actuation hole 72 may have a standard size for access by standard hand tools for rotation of the locking element 64. In an embodiment, the locking element 64 may be have collar 70 configured to be engageable with a hand tool for rotation of the locking element 64.

The body 62 may have a lock element aperture 74. The lock element aperture 74 may be threaded. A limit member 76 may fit into the lock element aperture 74. The lock element aperture 74 may extend partially through body 62. The lock element aperture 74 may be positioned between the collar 70 and the cut-out arc 68. In an embodiment, the lock element aperture 74 may be extend through the body 62.

The locking element 64 may be retained on the adapter frame 14. The locking element 64 may be rotatably supported on the housing 40 of the adapter frame 14.

In an embodiment, each locking element 64 may be retained on the housing 40 by a lock cover 77. With reference to FIGS. 2 to 3, the lock cover 77 may be connected to the housing 40 of adapter frame 14. The lock cover 77 may comprise a body 98. The lock cover 77 may be configured to accommodate the locking element 64 which is positioned on the housing 40. The body 98 may be configured to accommodate the locking element 64.

In an embodiment, the lock cover 77 may be disk-shaped.

Each locking element 64 may have a lock cover rib 94 extending along the border of the body 98. The locking element 64 which may be disposed in the cavity 59 may be held within the lock cover rib 94 at the second coupling seat 42. The locking element 64 may be rotatably held within the lock cover rib 94.

Each lock cover rib 94 may be configured to engage the second abutment portions 56. The lock cover rib 94 may have bolt holes 80. The number and distribution of the bolt holes 80 may correspond to the number and distribution of the bolt holes 57 on the second abutment portions 56. Bolts 82 may fit into the bolt holes 80 to connect the lock cover 77 to the housing 40 at each second coupling seat 42. Washers 84 may be provided.

In an embodiment, the lock cover rib 94 may encircle the lock cover 77. In an embodiment, the lock cover rib 94 may partially encircle the lock cover 77 to leave an open segment 96 of the border of body 98. A portion of the locking element 64 may be visible with locking element 64 assembled with the locking cover 77. A portion of the locking element 64 may have a colour or design to indicate the open or close position of the locking element 64.

The lock cover 77 may comprise a cover orifice 78. The cover orifice 78 may extend through the body 98. The cover orifice 78 may be positioned in the centre of the lock cover 77. The cover orifice 78 may have a shape and dimension to receive the collar 70 of the locking element 64. With the lock cover 77 assembled with the locking element 64, the collar 70 may be located within the cover orifice 78 so that the actuation hole 72 may remain accessible.

A lock cover aperture 86 may be provided in the lock cover 77. The lock cover aperture 86 may extend through the body 98. The lock cover aperture 86 may be positioned adjacent the cover orifice 78. The lock cover aperture 86 may be configured for the limit member 76 fit there through.

In an embodiment, the locking element 64 may be enclosed between the rib portion 58 and the body 98 of the lock cover 77. The lock cover rib 94 may extend more than 180° around the circumference of the locking element 64 so as to surround and retain the locking element 64 on the housing 40.

In an embodiment, the locking element 64 may be retained in the housing 40 by other suitable means.

The locking element 64 may be retained in grooves provided within the housing 40. The locking element 64 may be rotatably retained in the grooves. The locking element 64 may be held in the open or closed positions by a retaining pin inserted through the housing 40 and the locking element 64.

With reference to FIGS. 2 to 3, the locking element 64 and the lock cover 77 may be assembled at each second coupling seat 42 of the adapter frame 14. The locking element 64 and the lock cover 77 may be assembled on the housing prior to the coupling of the jaw set 12 and the adapter frame 14.

The locking elements 64 may be disposed at the second coupling seats 42. FIG. 1 illustrates the retaining member 90, with the body 62 not shown, in engagement with the second abutment portion 56. The retaining members 90 may positioned within the cavities 59. The retaining members 90 may be rotatable within the abutment portions 56. The retaining members 90 may extend partially across the abutment portions 56 such that a portion of the abutment portions 56 may be free to engage the ring members 32. The enclosures 91 may be located within the cavities 59.

With reference to FIGS. 2 and 3, the body 62 of each locking element 64 may extend over the rib portions 58. The body 62 of each locking element 64 may slidably engage the rib portions 58. The lock element 64 may be disposed into or removed from the second coupling seats 42 in a direction substantially perpendicular to the housing 40.

Each locking elements 64 may be retained at the second coupling seats 42 by the lock cover 77 connected to the second abutment portion 56 and with the locking element accommodated within the lock cover 77. The locking element 64 may be rotatably held by the lock cover 77. The lock cover rib 94 may fit around the rib portion 58. The lock cover rib 94 may engage the rib portion 58. The lock cover rib 94 may engage the side of rib portion 58 opposite cavity 59.

Figure 6A:
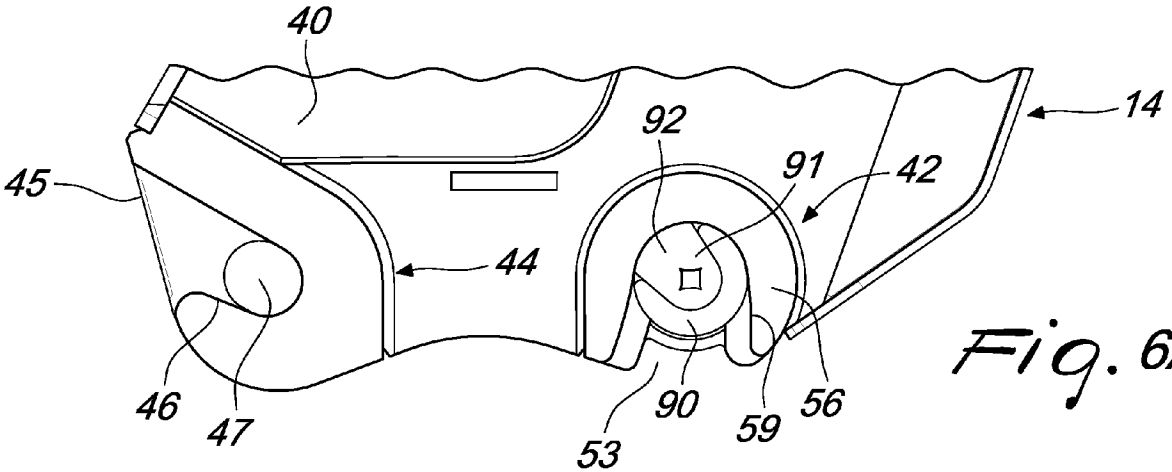
FIG. 6A is a sectional view of a part of the adapter frame of FIG. 2 with the locking element in the closed position.
Figure 6B:
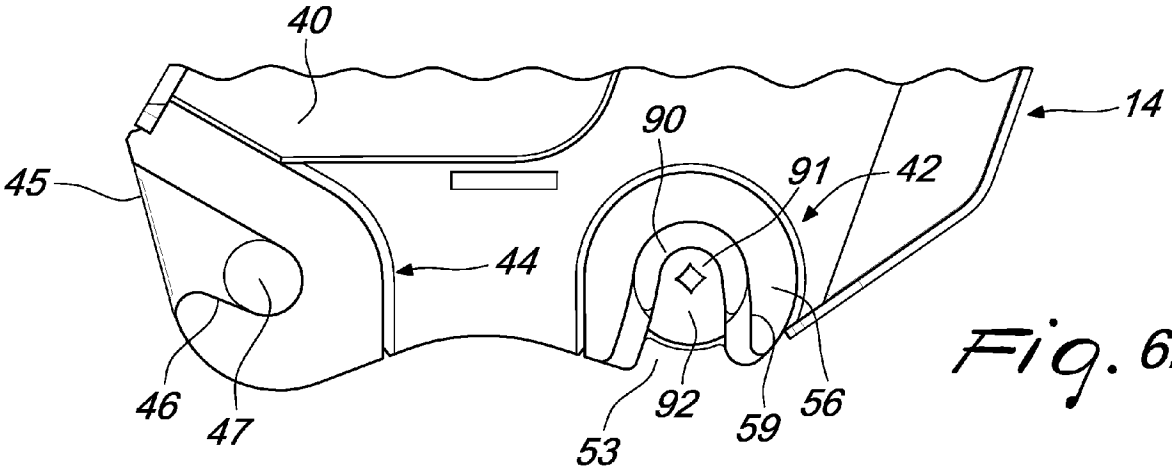
FIG. 6B is a sectional view of a part of the adapter frame of FIG. 2 with the locking element in the open position.

FIGS. 6A and 6B illustrate the retaining member 90, with the body 62 not shown, disposed within the second abutment portion 56. In FIG. 6A, the locking element 64 may be in a closed position with the enclosure aperture 92 not in alignment to the opening 53. The locking element 64 may be rotated such that access to the opening 53 from the enclosure 91 is blocked by the retaining member 90. The enclosure aperture 92 may be positioned at second abutment portion 56. The opening 53 may be blocked by the retaining member 90. An end of the rod member 30 may be locked in the cavity 59 of the second coupling seat 42 by the retaining member 90.

The retaining member 90 may be in sliding engagement with a portion of the second abutment portion 56. The ring member 32 may be in abutting engagement with the portion of the second abutment portion 56 not in engagement with the retaining member 90.

In an embodiment, the ring member 32 may be in engagement with the portion of the second abutment portion 56 closer to the void 38 and the retaining member 90 may be in sliding engagement with a portion of the second abutment portion 56 further from the void 38.

In an embodiment, the ring member 32 and the retaining member 90 may be arranged in a stack with respect to the central axis of the each cavity 59. With respect to the central axis of the cavity 59, the ring member 32 may be disposed towards the interior of the housing 40 and the retaining member 90 may be disposed away from the interior of the housing 40. In FIG. 6B, the locking element 64 may be in an open position with the enclosure aperture 92 being aligned to the opening 53. In alignment, the enclosure aperture 92 may coincide with the opening 53.

The locking element 64 may be rotated to be in alignment with the enclosure aperture 92 such that access to the enclosure 91 from the opening 53 is not blocked by the retaining member 90.

With the locking element 64 in an open position, an end of the rod member 30 may enter the cavity 59 through the opening 53. The end of the rod member 30 may pass through the enclosure aperture 92 into the enclosure 91.

The locking element 64 may be rotated to be in alignment with the enclosure aperture 92 such that access to the opening 53 from the enclosure 91 is not blocked by the retaining member 90.

With the locking element 64 in an open position, an end of the rod member 30 may no longer be locked in the cavity 59 of the second coupling seat 42 by the retaining member 90. The rod member 30 may move from the enclosure 91 through the enclosure aperture 92 to the opening 53 and out of the cavity 59.

With reference to the FIGS. 7A to 7E, a method of assembling the demolition apparatus 10 may comprise the following steps. A jaw set 12 having a first jaw 16 pivotally connected to a second jaw 18 may be provided. The jaw set 12 may further comprise a pivot pin 26 extending through the pivotal connection of the first and second jaws 16, 18 and a coupling pin 28 provided on the first jaw 16. The adapter frame 14 may be connected to the arm of a machine. The adapter frame 14 may have spaced-apart first and second coupling seats 44, 42 to engage with the pivot pin 26 and the coupling pin 28, and a cylinder 48 to pivot the second jaw 18 relative to the first jaw 16, wherein the openings 51, 53 of the first coupling seat 44 and the second coupling seat 42 face different directions. The adapter frame 14 may be moved to engage the pivot pin 26 into the first coupling seats 44 and the coupling pin 28 may be engaged into the second coupling seats 42 through rotation of the jaw set 12 relative to the adapter frame 14.

The adapter frame 14 connected to the arm of a machine may be moved by the operator of the machine towards the jaw set 12 which may be resting on a surface, for example the ground.

Figure 7A:
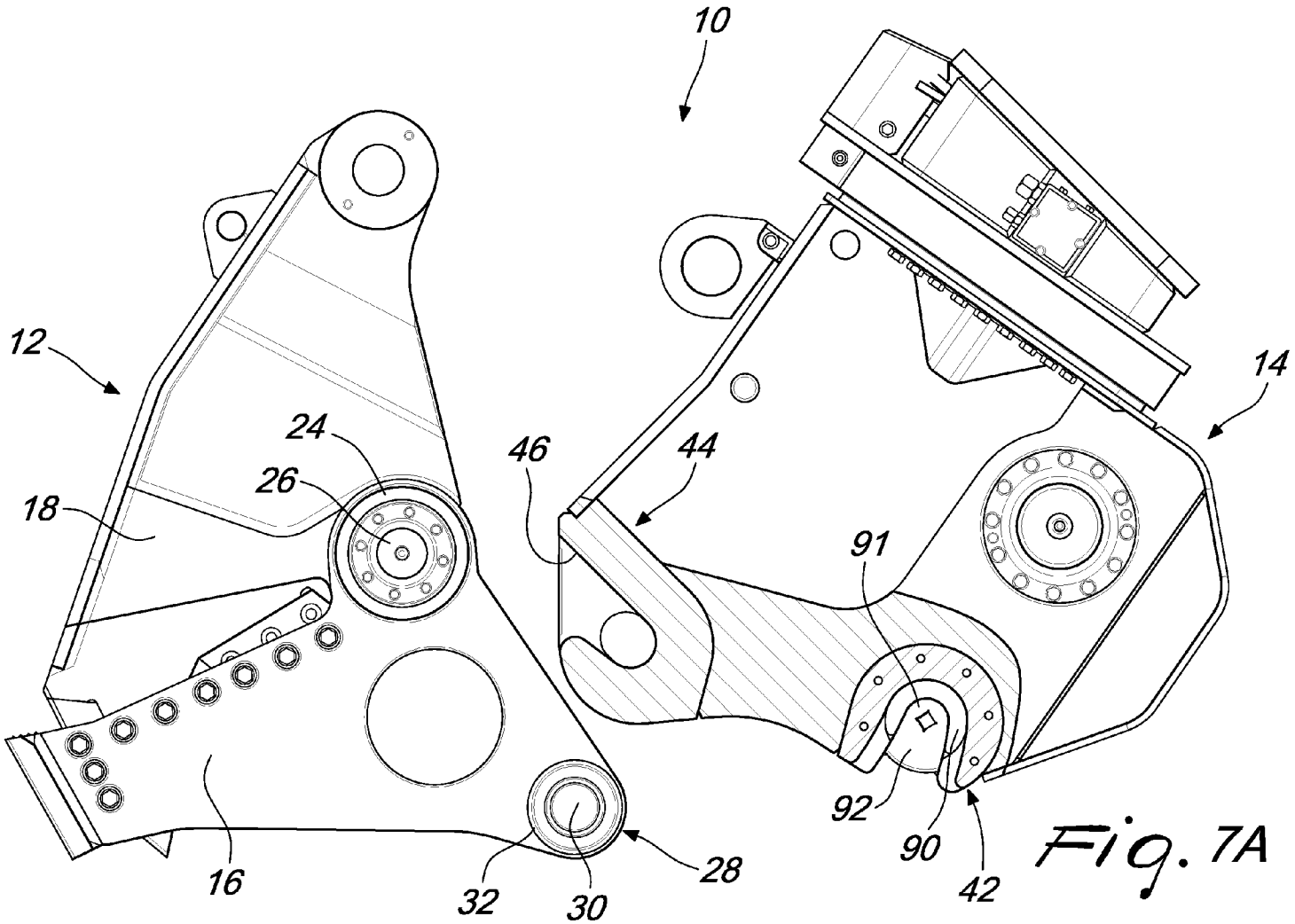
FIG. 7A is a side view of the demolition apparatus of FIG. 1 with the adapter frame partially sectioned at the coupling seats in an approach to the jaw set.

FIG. 7A illustrates the adapter frame 14 with the first and the second coupling seats 44, 42, at a side, being in a sectional view. The adapter frame 14 may first be moved towards the jaw set 12. The adapter frame 14 may be aligned for engagement of the first coupling seats 44 and the coupling pin 28. The adapter frame 14 may be moved such that the first coupling seats 44 may be moved in a direction towards the pivot pin 26.

In an embodiment, the step of moving the adapter frame 14 may comprise a movement in the direction of extension of the cylinder 48.

In an embodiment, the step of moving the adapter frame 14 may comprise a relative movement of the pivot pin 26 along an engagement path of the first coupling seat 44.

In an embodiment, the pivot pin 26 may enter the openings 51 of the first coupling seats 44 in a direction towards the coupling pin 28.

Figure 7B:
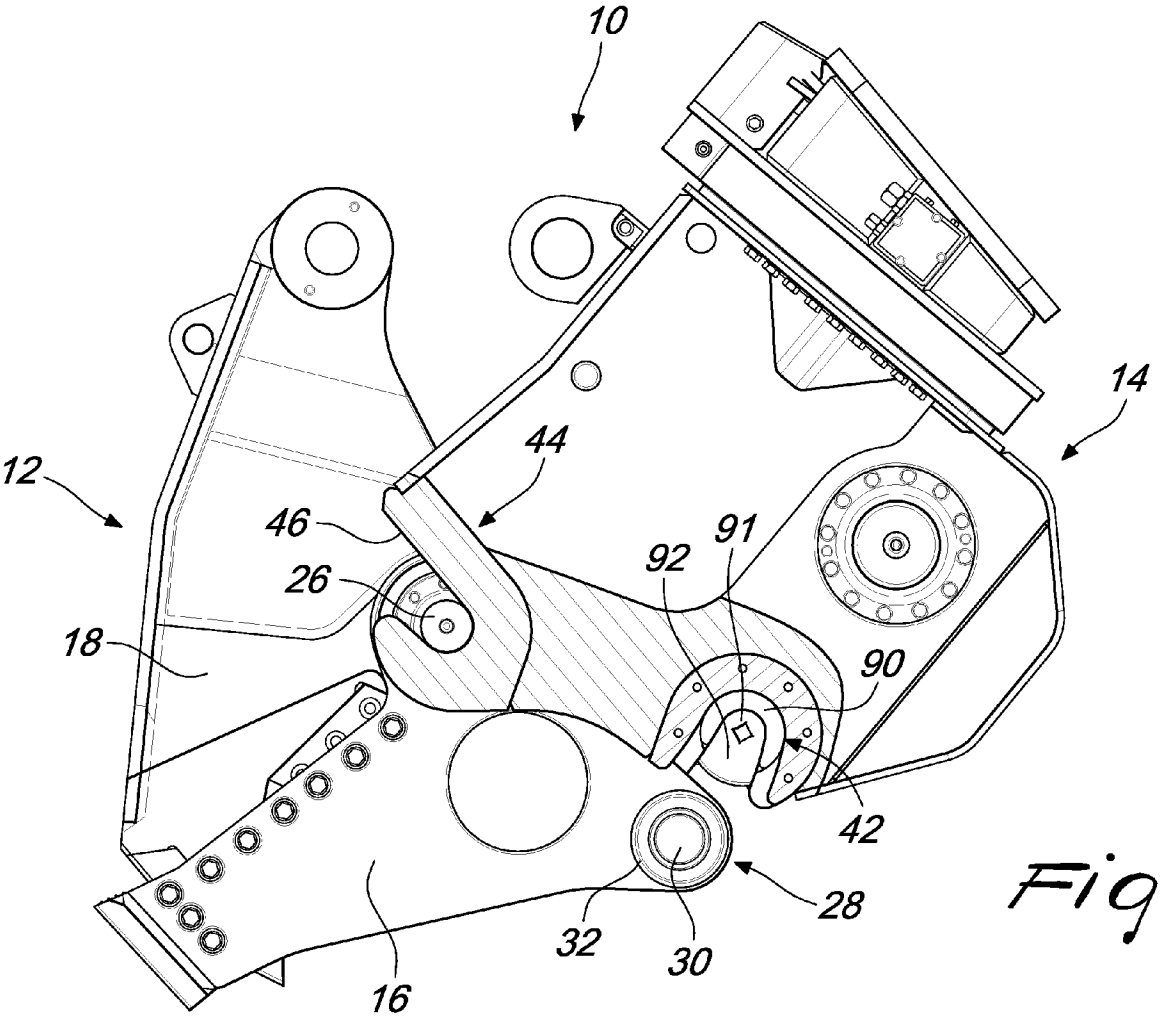
FIG. 7B is a side view of the demolition apparatus of FIG. 1 with the adapter frame partially sectioned at the coupling seats and engaged to the jaw set at a first engagement point.

FIG. 7B illustrates the adapter frame 14 with the first and the second coupling seats 44, 42, at a side, being in a sectional view. The pivot pin 26 may be engaged in the first coupling seats 44 at the first engagement point. The ends of the pivot pin 26 may be in engagement with the first abutment portions 49 of the first coupling seats 44.

As the adapter frame 14 continues to move the jaw set 12 may begin to be lifted from the surface. As the jaw set 12 is lifted the adapter frame 14 and the jaw set 12 may rotate relative to each other at the first engagement point. The relative rotation of the adapter frame 14 and the jaw set 12 may bring the coupling pin 28 into engagement of the second coupling seat 42.

In an embodiment, the jaw set 12 may rotate relative to the adapter frame 14 for engagement of the coupling pin 28 into the second coupling seat 42. The adapter frame 14 may continue to be moved in the direction in which the pivot pin 26 was engaged into the first coupling seats 44. The jaw set 12 may undergo a rotation relative towards the adapter frame 14 about the first engagement point.

In an embodiment, the adapter frame 14 may be rotated relative to the jaw set 12 for engagement of the coupling pin 28 into the second coupling seat 42. The adapter frame 14 may continue to be moved in the direction in which the pivot pin 26 was engaged into the first coupling seats 44 while undergoing a relative rotation towards the jaw set 12 about the first engagement point.

In an embodiment, the step of engaging the coupling pin 28 into the second coupling seat 42 may comprise moving the coupling pin 28 along the engagement trajectory of the second coupling seat 42. The engagement path of first coupling seat 44 may intersect the engagement trajectory of the second coupling seat 42.

Figure 7C:
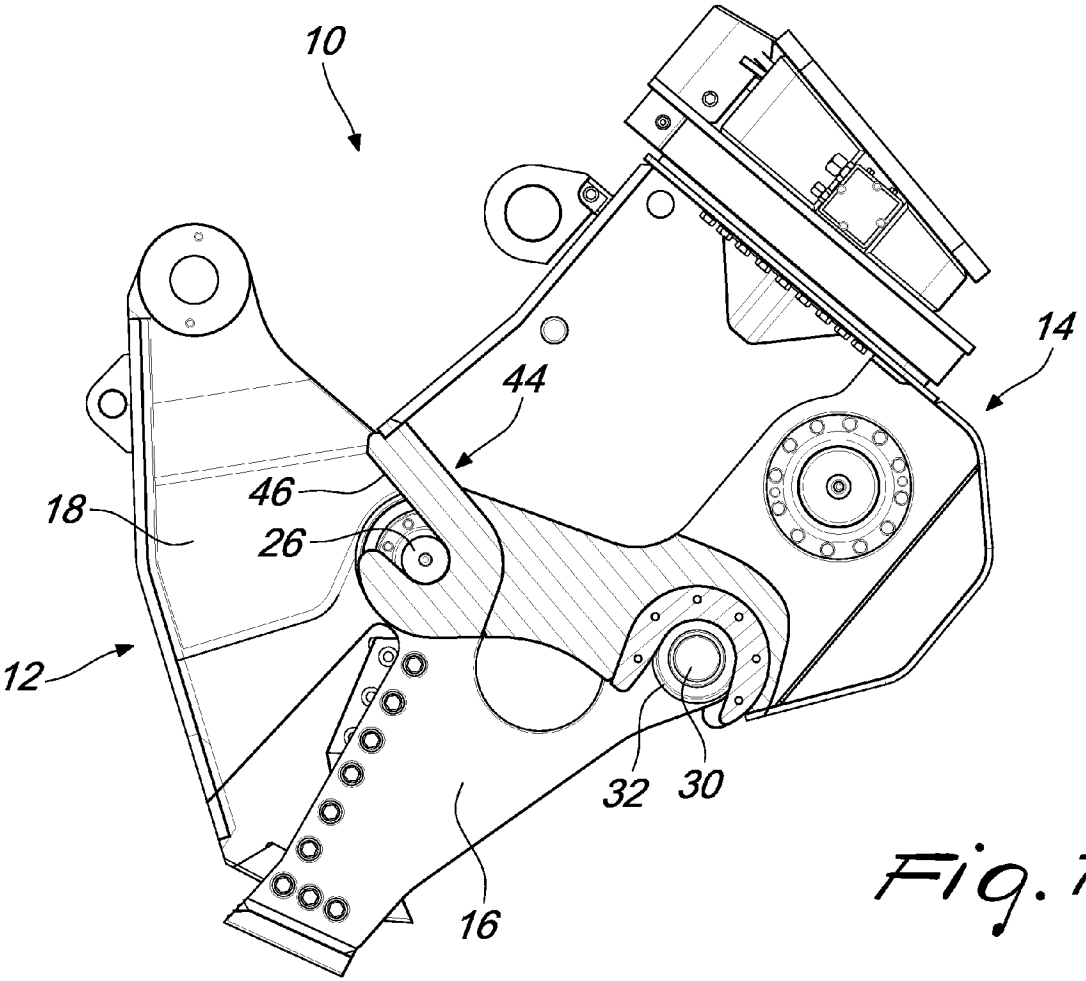
FIG. 7C is a side view of the demolition apparatus of FIG. 1 with the adapter frame partially sectioned at the coupling seats and engaged to the jaw set at a first engagement point and a second engagement point and the locking element is in an open position.

FIG. 7C illustrates the adapter frame 14 with the first and the second coupling seats 44, 42, at a side, being in a sectional view. The coupling pin 28 may be engaged in the second coupling seat 42. The ring member 32 may be in abutting engagement with the second abutment portion 56 of the second coupling seats 42. The end of the rod member 30 may not be in abutting engagement with the second abutment portion 56. The end of the rod member 30 may be available for engagement with the retaining member 90 of each locking element 64.

Figure 7D:
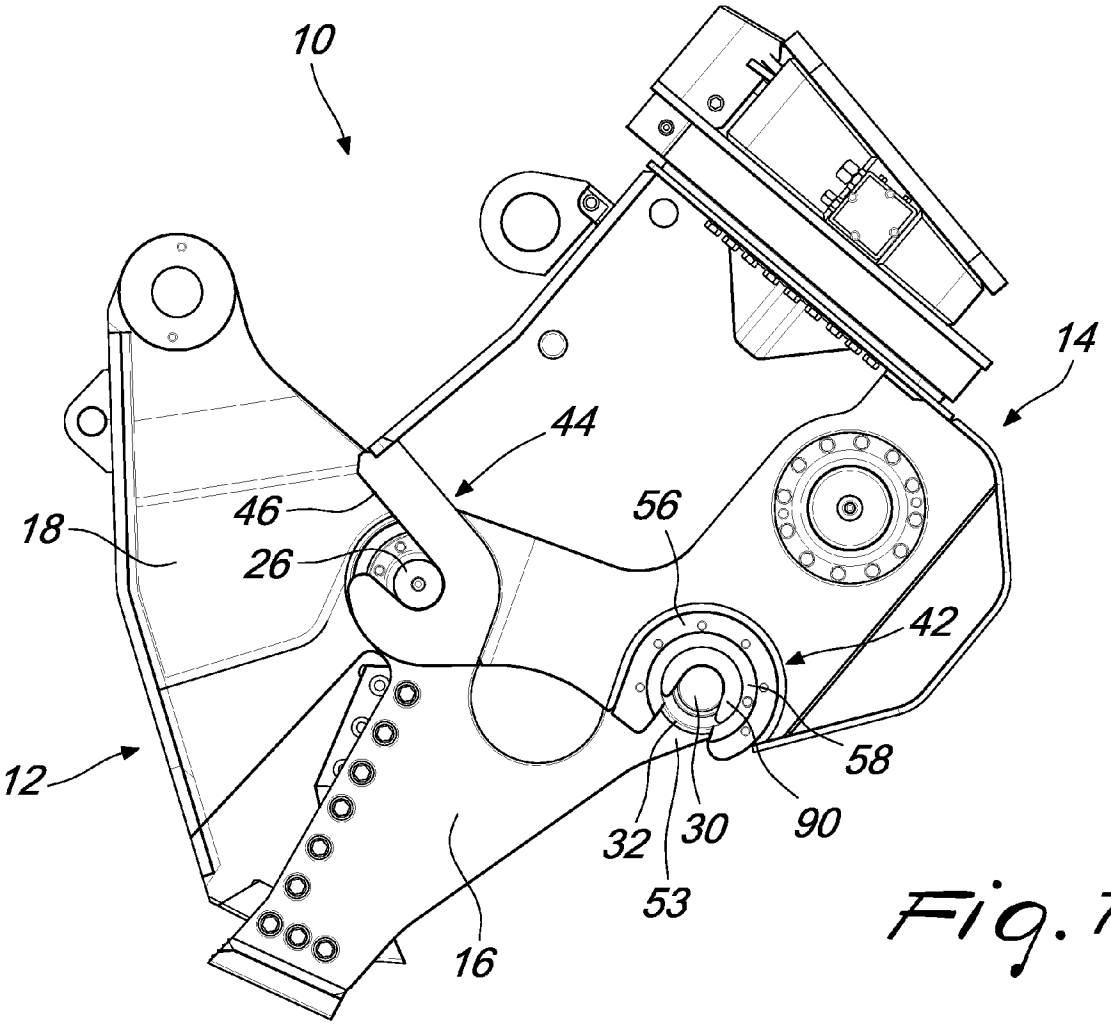
FIG. 7D is a side view of the demolition apparatus of FIG. 1 with the adapter frame engaged to the jaw set at a first engagement point and a second engagement point and the locking element is in an open position.

FIG. 7D illustrates the adapter frame 14 with the retaining member 90 at the second coupling seat 42 and the coupling pin 28 engaged at the second coupling seat 42.

The coupling pin 28 may be engaged in the second coupling seat 42. The ring member 32 may be in abutting engagement with the second abutment portion 56 of the second coupling seat 42. The rod member 30 may be in sliding engagement with the retaining member 90. The retaining member 90 may be moveable in the space between the rod member 30 and the second abutment portion 56.

The retaining member 90 may be positioned such that the opening 53 and the enclosure aperture 92 may be in alignment. The rod member 32 may be able to access the enclosure 91 through the enclosure aperture 92. The ring member 32 may be able to move out of the cavity 59 through the opening 53.

Figure 7E:
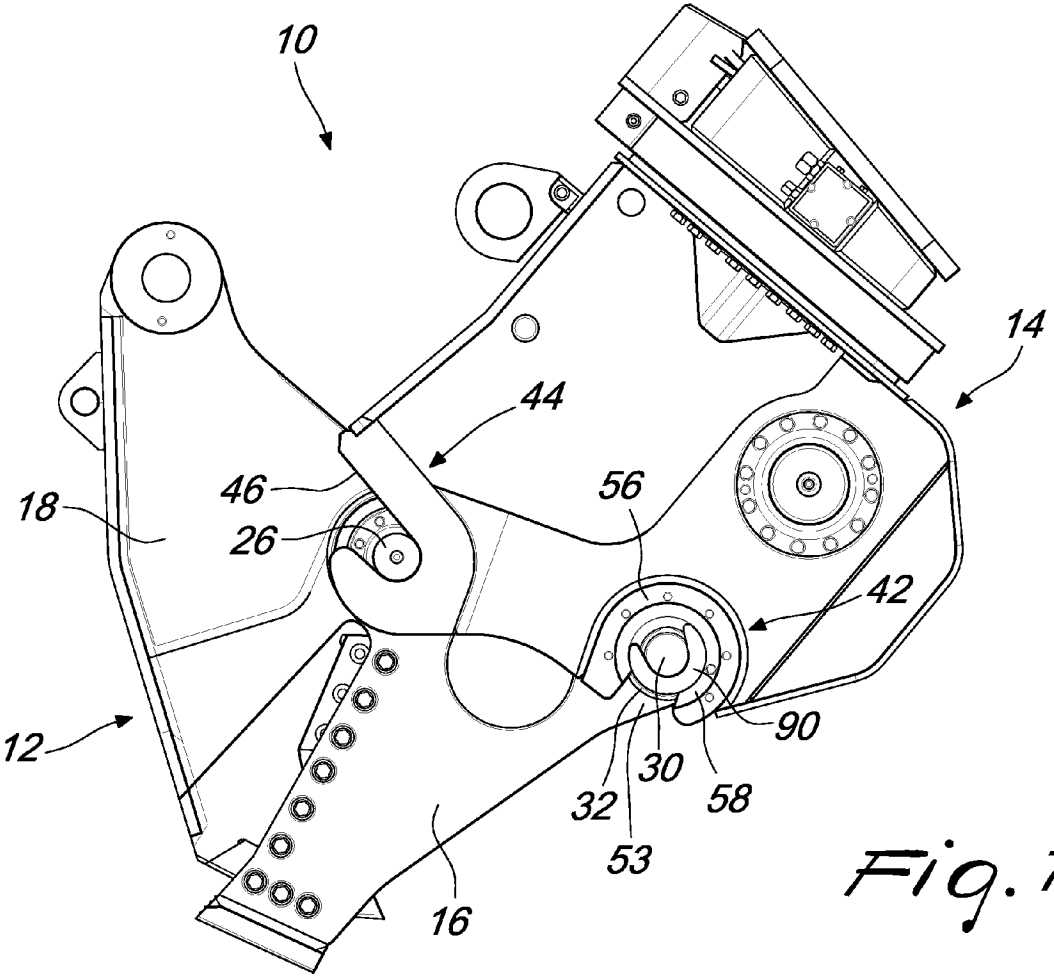
FIG. 7E is a side view of the demolition apparatus of FIG. 1 with the adapter frame engaged to the jaw set at a first engagement point and a second engagement point and the locking element is in a closed position.

FIG. 7E illustrates the adapter frame 14 with the retaining member 90 at the second coupling seat 42 and the coupling pin 28 engaged at the second coupling seat 42.

The coupling pin 28 may be engaged in the second coupling seat 42. The ring member 32 may be in abutting engagement with the second abutment portion 56 of the second coupling seat 42. The rod member 30 may be in sliding engagement with the retaining member 90. The retaining member 90 may be moveable in the space between the rod member 30 and the second abutment portion 56.

The retaining member 90 may be moved to the closed position so that the opening 53 and the enclosure aperture 92 may not be in alignment. The rod member 30 may not be able to exit from the enclosure 91 through the enclosure aperture 92. The enclosure aperture 92 may be positioned at second abutment portion 56. The opening 53 may be blocked by the retaining member 90. With the end of the rod member 30 being locked in the enclosure by the retaining member 90, the ring member 32 may be not able to exit from the cavity 59 through the opening 53.

The disassembly of the demolition apparatus 10 may proceed in the reverse order. The retaining member 90 may be moved to the open position so that the opening 53 and the enclosure aperture 92 may be in alignment. The openings 53 may not be blocked by the retaining members 90.

With the ends of the rod members 30 no longer being locked in the enclosure 91 by the retaining members 90, the ring members 32 may be able to exit from the cavities 59 through the openings 53. The rod member 32 may be able to exit the enclosure 91 through the enclosure aperture 92.

The coupling pin 28 may then be disengaged from the second coupling seats 42. The demolition apparatus 10 may begin to be lowered to the surface. The adapter frame 14 and the jaw set 12 may undergo relative rotation for disengagement the coupling pin 28 from the second coupling seats 42. The adapter frame 14 and the jaw set 12 may rotate relative to each other at the first engagement point.

In an embodiment, the jaw set 12 may rotate relative to the adapter frame 14 for disengagement of the coupling pin 28 from the second coupling seat 42. The adapter frame 14 may be moved in the reverse direction in which the pivot pin 26 was engaged into the first coupling seats 44. The jaw set 12 may undergo a rotation relative away from the adapter frame 14 about the first engagement point.

In an embodiment, the adapter frame 14 may be rotated relative to the jaw set 12 for disengagement of the coupling pin 28 from the second coupling seat 42. The adapter frame 14 may be moved in the reverse direction in which the pivot pin 26 was engaged into the first coupling seats 44 while undergoing a relative rotation away from the jaw set 12 about the first engagement point.

In an embodiment, the step of disengaging the coupling pin 28 from the second coupling seat 42 may comprise moving the coupling pin 28 along the engagement trajectory of the second coupling seat 42.

At disengagement of the coupling pin 28 from the second coupling seat 42, the operator may continue to lower the demolition apparatus 10 and the jaw set 12 may continue to be lowered towards the surface. The adapter frame 14 and the jaw set 12 may undergo further relative rotation.

Once the jaw set 12 is brought to rest on the surface, the adapter frame 14 may be moved so as to disengage the pivot pin 26 from the first coupling seats 44.

The adapter frame 14 may be moved such that the first coupling seats 44 may be moved in a direction away from the pivot pin 26.

In an embodiment, the step of moving the adapter frame 14 may comprise a movement in the direction of retraction of the cylinder 48.

In an embodiment, the step of moving the adapter frame 14 may comprise moving the pivot pin 26 along an engagement path of the first coupling seat 44.

In an embodiment, the pivot pin 26 may exit the first coupling seats 44 in a direction away from the coupling pin 28.

Figure 8:
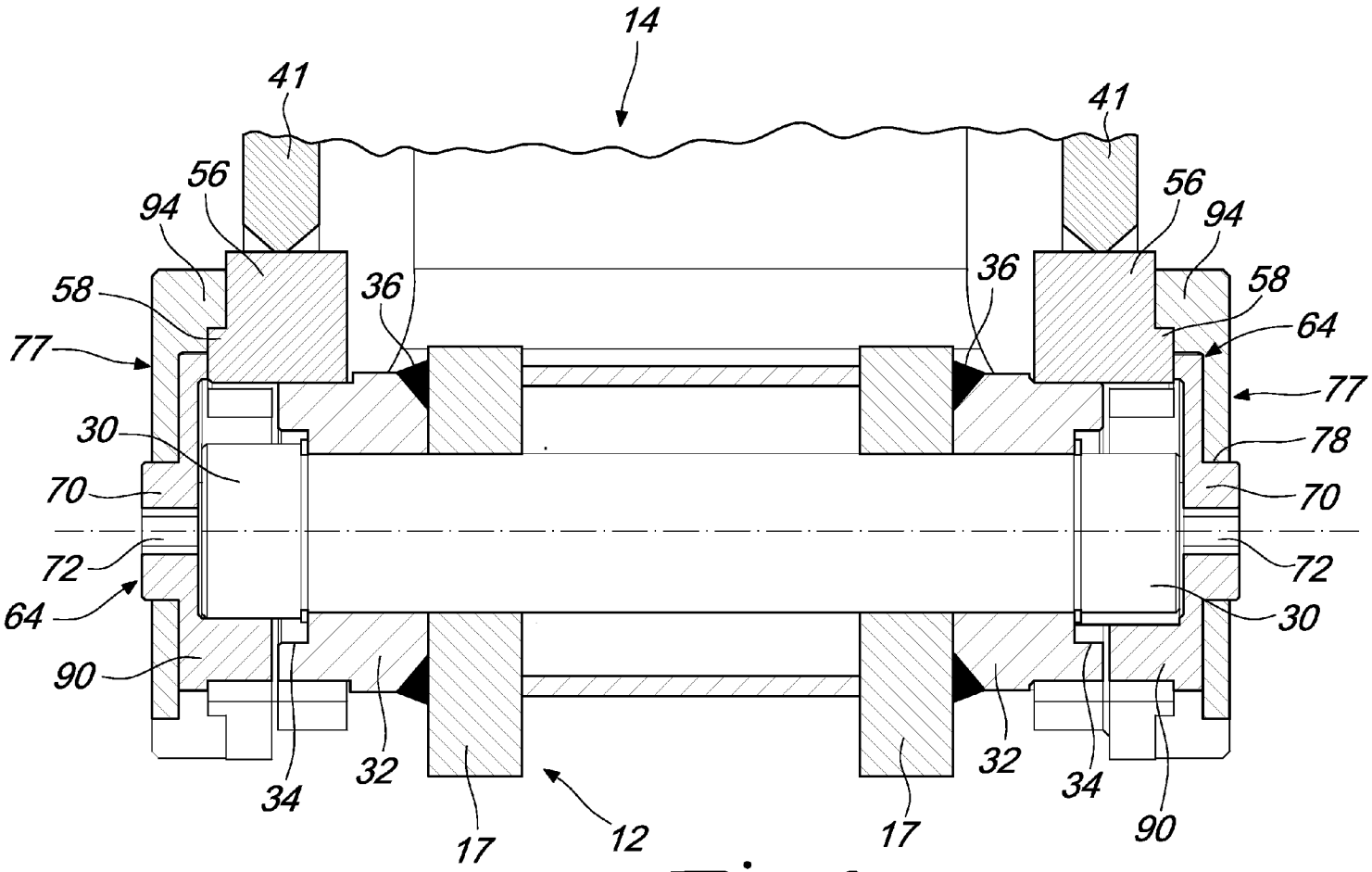
FIG. 8 is a cross section view of the second engagement point of the adapter frame engaged to the jaw set in FIG. 7C.

FIG. 8 illustrates a cross section view of the second engagement point of the adapter frame 14 engaged to the jaw set 12. The coupling pin 28 may be engaged in the second coupling seat 42. The ring members 32 may be in abutting engagement with the second abutment portions 56.

The rod member 30 may be in engagement with the ring members 32. The ends of the rod member 30 may extend beyond the ring members 32 into the cavities 59.

In an embodiment, the ends of the rod member 30 may be aligned to the rib portions 58. The ends of the rod member 30 may be spaced from the ring members by the groove 34.

The locking elements 64 may be disposed in the cavities 59. The retaining members 90 may extend into the cavities 59. The lock covers 77 may be positioned over the locking elements 64. The lock cover ribs 94 of the lock covers 77 may be connected to the rib portions 58.

Figure 9:
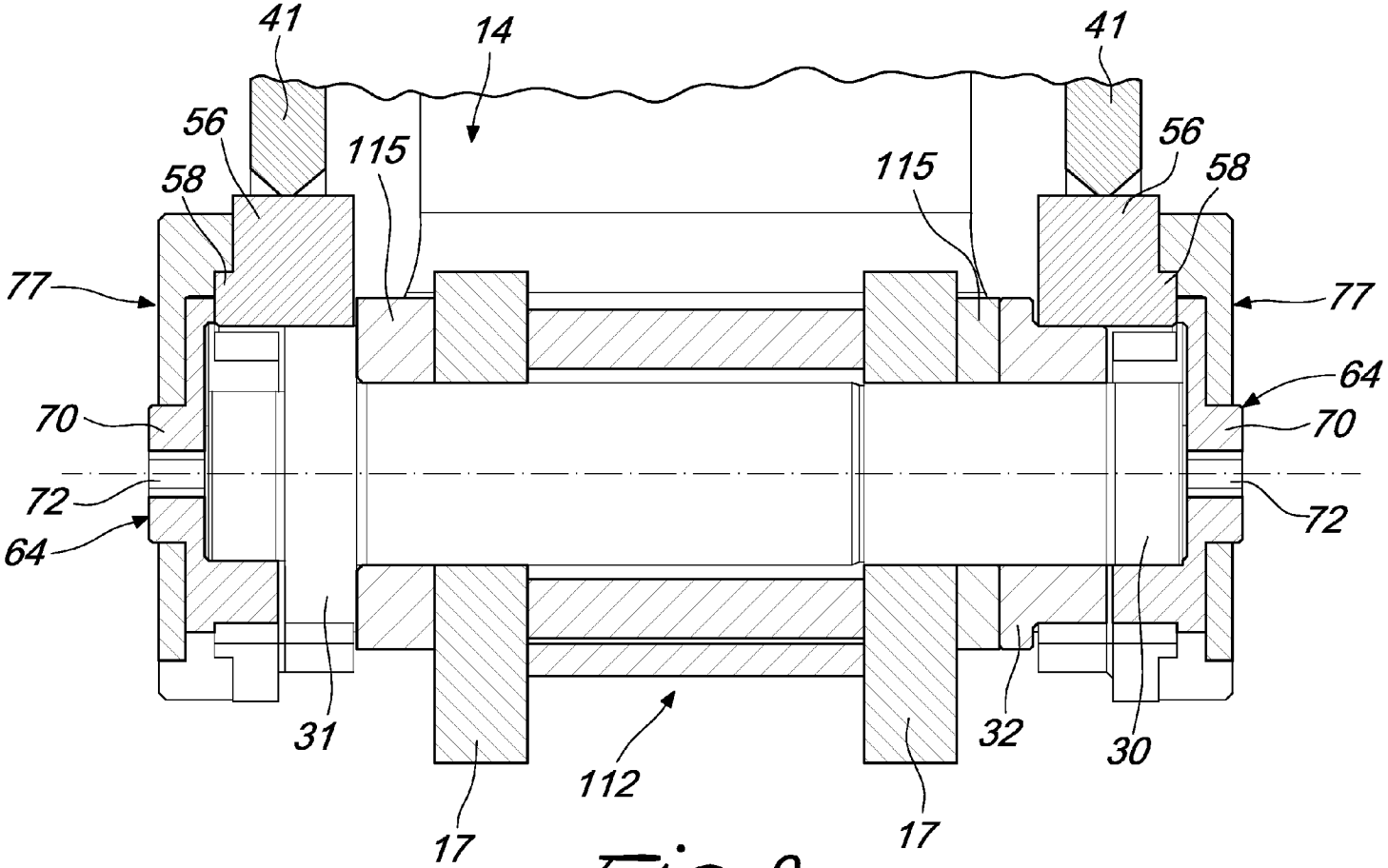
FIG. 9 is a cross section view of the second engagement point of the adapter frame engaged to a second embodiment jaw set.

FIG. 9 illustrates a cross section view of the second engagement point of the adapter frame 14 engaged to a second embodiment jaw set 112. In the second embodiment jaw set 112, the coupling pin 28 may comprise only one ring member 32 at one end. At the opposite end, the coupling pin 28 may comprise a pin collar 31.

The ring member 32 may not be fixedly connected to the jaw set 112. The ring member 32 may be removably connected to the jaw set 112. The ring member 32 may engage the rod member 30, already inserted through frame plates 17, by sliding the ring member 32 onto an end of the rod member 32 opposite the pin collar 31 and by sliding towards the frame plate 17.

In an embodiment, the second embodiment jaw set 112 may comprise a pair of annular members 115. A first annular member 115 may be disposed between the ring member 32 and the frame plate 17. A second annular member 115 may be disposed between the pin collar 31 and the opposite frame plate 17. The annular members 115 may be welded to the respective frame plates 17. The annular members 115 may be in engagement with the rod member 30. In an embodiment, the annular members 115 may have substantially the same diameter as the ring member 32.

At the end with the ring member 32, the ring member 32 may be in abutting engagement with the second abutment portion 56. At the opposite end the pin collar 31 may be in abutting engagement with the opposite second abutment portion 56. The ends of the rod member 30 may extend beyond the ring member 32 and the pin collar 31 into the cavities 59. The locking elements 64 may be disposed in the cavities 59. The retaining members 90 may extend into the cavities 59. The lock covers 77 may be positioned over the locking elements 64. The lock cover ribs 94 of the lock covers 77 may be connected to the rib portions 58.

Figure 10:
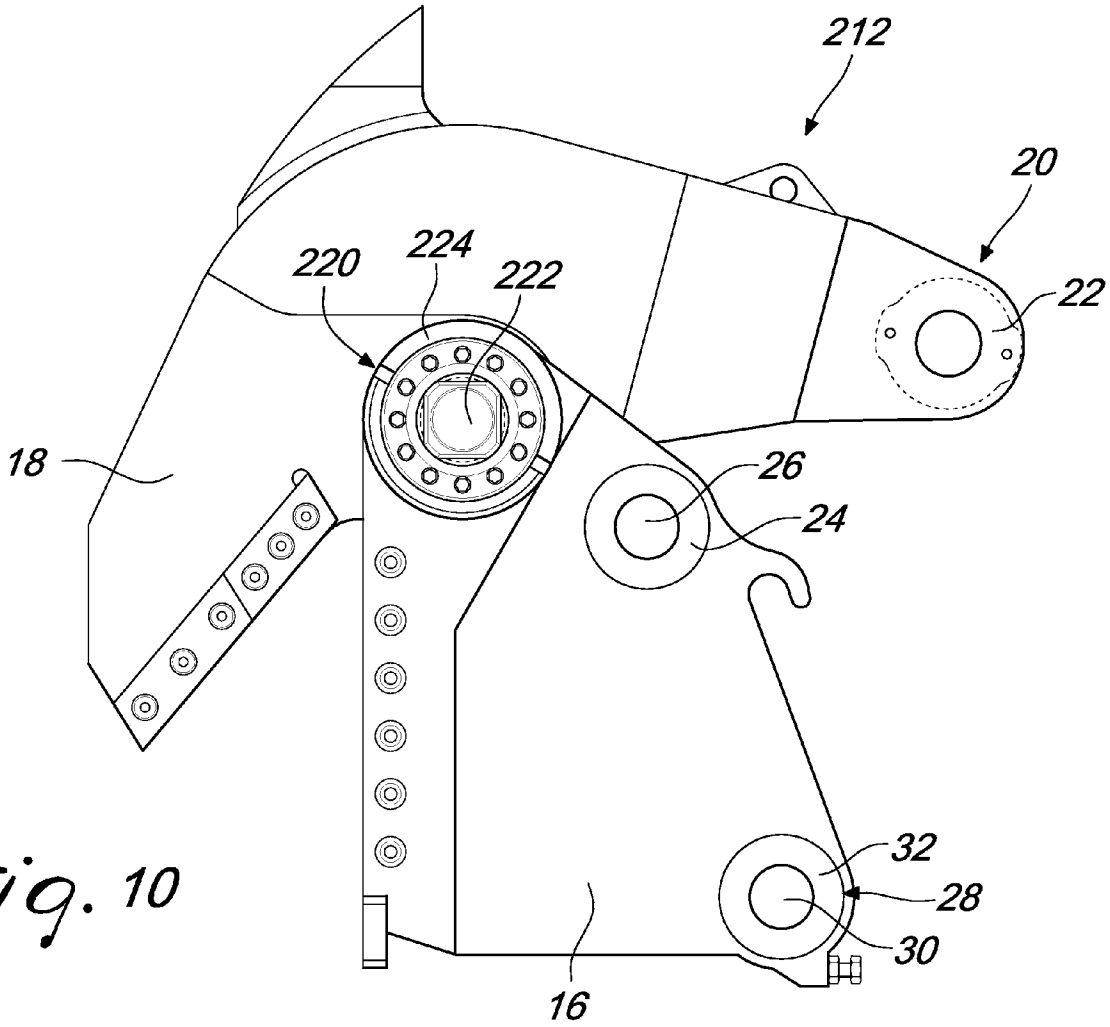
FIG. 10 is a side view of a third embodiment jaw set according to the present disclosure.

FIG. 10 illustrates a third embodiment of the jaw set 212 wherein the first jaw 16 may be pivotaly connected to the second jaw 18 at a pivot point 220. The first jaw 16 and the second jaw 18 may be pivotaly connected by a pin 222 or by a bushing. The pin 222 may be retained to the jaw set 212 by the lock ring 224.

The jaw set 212 have be provided with actuation portion 20 having stiffening passages 22 as described in the foregoing passages.

A coupling ring 28 may be provided on the first jaw 16 as described in the foregoing passages.

A pivot pin 26 may be provided in the first jaw 16. In an embodiment, the ends of the pivot pin 26 may protrude from both sides of the jaw set 212. The ends of the pivot pin 26 may protrude perpendicularly with respect to the first jaw 16.

In an embodiment, the first jaw 16 may be retained on the pivot pin 26 without play along the length of the pivot pin 26. The first jaw 16 may be retained on the pivot pin 26 so that lateral movement may be restricted and rotational movement may not be restricted. A lock ring 24 may be positioned at the end of the pivot pin 26 protruding from the jaw set 212 to engage and lock the pivot pin 26 with respect to the first jaw 16. In an embodiment, the lock rings 24 may be positioned at both ends of the pivot pin 26 protruding at both ends of the first jaw set 16.

The first jaw 16 may each be provided with a passage to accommodate the pivot pin 26. In an embodiment, the plates 17 of the first jaw 16 may be provided with passages to accommodate the pivot pin 26. In an embodiment, the lock ring 24 may be positioned between the end of the pivot pin 26 and the plates 17.

In an embodiment, the pivot pin 26 may be positioned between the coupling pin 28 and the pivot point 220. The pivot pin 26 may be positioned nearer to the pivot point 220 and spaced away from the coupling pin 28. In an embodiment, the pivot pin 26 may be in an off-set position relative to the coupling pin 28 and the pivot point 220.

The skilled person would appreciate that foregoing embodiments may be modified or combined to obtain the adapter frame 14 or the demolition apparatus 10 of the present disclosure.

INDUSTRIAL APPLICABILITY

This disclosure describes a demolition apparatus 10 comprising jaw set 12, 112, 212 and an adapter frame 14. The adapter frame 14 may be configured so as to engage and lift the jaw set 12, 112, 212 at a first point of engagement so that the relative rotation between the jaw set 12, 112, 212 and an adapter frame 14 may effect an engagement at a second point of engagement. The first engagement point serves as a rotation axis of the jaw set 12, 112, 212 and the adapter frame 14 for mutual engagement at the second point of engagement.

This connection of the jaw set 12, 112, 212 and the adapter frame 14 provides for a quick and simple assembly of the demolition apparatus 10. The assembly and disassembly of the demolition apparatus 10 requires less skill and effort on the part of the operator.

At the second point of engagement, the rod member 30 of the coupling pin 28 may be locked to the housing 40 of the adapter frame 14 by a locking element 64. The locking element 64 may be rotated from an open position wherein the openings 53 of the second coupling seats and the enclosure apertures 92 may be aligned to a close position wherein the openings 53 of the second coupling seats and the enclosure apertures 92 may not be in alignment. In the close position the rod member 30 may be locked in the enclosure 91. The ends of the rod member 30 may be held in the locked position between the retaining member 90 of the locking element 64 and the second abutment portions 56.

The locking element 64 may be easily serviced leading to reduction in maintenance time and cost.

In the locked position any force exerted on the jaw set 12, 212 may be transmitted to the adapter frame 14 through the ring members 32 which may be in abutting engagement with the second abutment portions 56. No force may be transmitted through the rod member 30 as the rod member 30 may not be in abutting engagement with the second abutment portions 56. The rod member 30 may be held at a distance from the second abutment portions 56 by the ring member 32.

In the second embodiment of the jaw set 112, any force exerted on the jaw set 112 may be transmitted to the adapter frame 14 through the ring member 32 which may be in abutting engagement with the second abutment portion 56 on a second coupling seat 42 and the pin collar 31 which may be in abutting engagement with the second abutment portion 56 of the other second coupling seat 42.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

The disclosures in European Patent Application No. 11184008.8 from which this application claims priority are incorporated herein by reference.

Where technical features mentioned in any claim are followed by references signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The invention claimed is:

1. A demolition apparatus comprising:

a jaw set having a first jaw pivotally connected to a second jaw, the jaw set further comprising a pivot pin and a coupling pin provided on the first jaw;

an adapter frame having a housing provided with spaced-apart first and second coupling seats to engage with the pivot pin and the coupling pin and a cylinder to pivot the second jaw relative to the first jaw;

at least one locking element rotatably supported at the second coupling seat for retaining the coupling pin, the locking element includes a C-shaped retaining member to receive and engage the coupling pin;

wherein a cut-out arc extends along a portion of a circumference of the locking element; and wherein the cut-out arc is bound by stop limits formed on the locking element wherein the stop limits abut a limit element for restricting the rotation of the locking element.

2. The demolition apparatus of claim 1 wherein the position of the cut-out arc is aligned to the position of the C-shaped retaining member.

3. The demolition apparatus of claim 2 wherein the locking element is retained on the housing by a lock cover connected to the housing.

* * * * *